US005687854A

United States Patent [19]

Anderson

[11] Patent Number: 5,687,854

[45] Date of Patent: Nov. 18, 1997

[54] TOILET PAPER STORAGE RACK

[76] Inventor: Eugene Scott Anderson, 19810 Brookside Way, Perris, Calif. 92570

[21] Appl. No.: 340,906

[22] Filed: Dec. 27, 1994

[51] Int. Cl.[6] ..... A47F 7/00

[52] U.S. Cl. ..... 211/59.2

[58] Field of Search ..... 211/59.2, 106, 211/59.3; 312/42

[56] References Cited

U.S. PATENT DOCUMENTS

| | | | |
|---|---|---|---|
| 2,125,000 | 7/1938 | Considine | 211/59.2 |
| 3,659,722 | 5/1972 | Carroll | 211/106 |
| 4,732,282 | 3/1988 | Lockwood | 211/59.2 |
| 4,863,131 | 9/1989 | Kinseley | 211/59.2 |
| 5,197,611 | 3/1993 | Walton | 211/59.2 |

*Primary Examiner*—Alvin C. Chin-Shue

[57] ABSTRACT

A toilet paper storage rack is provided whereunder toilet rolls are removably contained within a storage rack comprising a number of loops and rods. There is provided an upper loop removably affixed to a wall or other structure. The lower loop also contains a larger cross sectional area portion so that the toilet paper rolls can be removed therefrom and from the rack. Attached to the upper loop is an attachment rod, which can be removed from the rack and mounted to a structure utilizing mounting brackets.

1 Claim, 2 Drawing Sheets

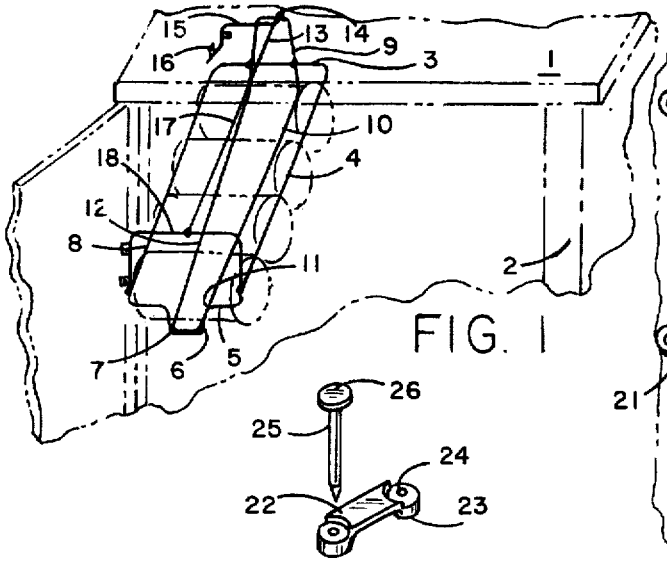
FIG. 1
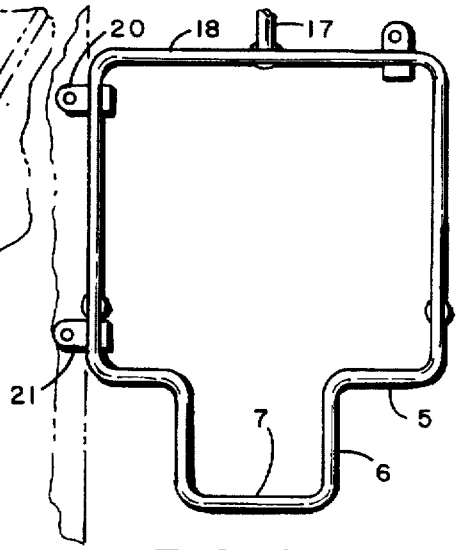
FIG. 2
FIG. 5
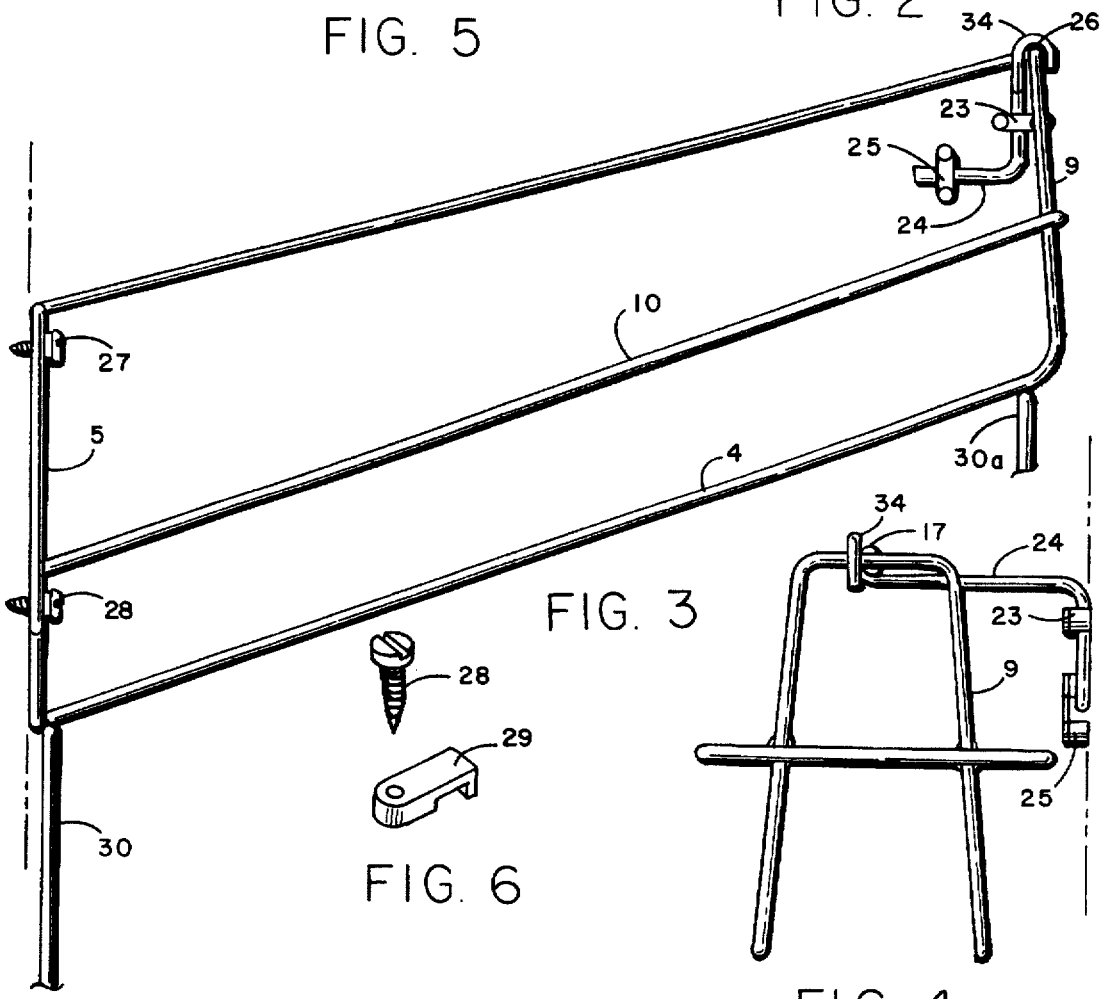
FIG. 3
FIG. 6
FIG. 4

TOILET PAPER STORAGE RACK

BACKGROUND OF THE INVENTION

The Invention relates to a device to store toilet paper. More particularly, the Invention relates to a storage rack which is attached to a cabinet or to a wall by a novel adjustable attachment means.

The novel storage rack of the Invention enables the user to store a number of toilet paper rolls either within a bathroom cabinet or adjacent to it, or on a wall near a toilet area.

Toilet paper storage racks are known in the prior art, as shown, for example, in U.S. Pat. No. 5,197,611. However, such storage racks generally do not provide for suitable attachment means so that the rack can be removably and conveniently attached to a cabinet, wall or other permanent structure. Additionally, Applicant has designed a novel rack whereunder the toilet rolls can be conveniently stored and removed from the storage area. The rack may be removably attached to a permanent structure utilizing a novel attachment hook means.

Accordingly, one object of the Invention is to provide a toilet paper storage rack, whereunder the toilet paper rolls can be readily removed from the rack. Another object of the Invention is to provide means whereunder the toilet paper storage rack can be removably attached to a permanent structure such as a cabinet or wall in the bathroom or toilet area. Other objects of the Invention will be apparent from the following description.

SUMMARY OF THE INVENTION

The subject Invention comprises, in essence, a number of metal rod members arranged whereunder a number of toilet paper rolls may be enclosed within the rack. One end of the rack is elevated from the other. The lower end of the rack contains a loop configuration whereunder the rolls may be conveniently removed from the storage area, yet held in place unless intentionally removed by the user.

The particularly novel feature of the Invention is a rod device which is affixed to a wall or the inside of a cabinet top while also being removably attached to the frame of the storage rack. Thus, the storage rack can be readily removed from the permanent wall or cabinet by simple manual movement of the adjustable attachment rod.

THE DRAWINGS

FIG. 1 is a perspective view of the Invention. FIG. 2 is a front view of the Invention depicting the loop area utilized to contain the toilet rolls, and an open area for removal of the rolls. FIG. 3 is a side view of the Invention depicting, in general, top, middle and bottom side bars which contain the toilet paper rolls and a lower post and an upper post for support of the storage rack. FIG. 4 shows a front view of the elevated portion of the rack depicting the attachment rod member permanently attached to a wall area and removably attached to the storage rack. FIG. 5 shows a mounting bracket for mounting of the attachment rod to the wall or cabinet structure. FIG. 6 shows the mounting bracket utilizing a screw for attachment of an attachment rod to a permanent structure. FIG. 7 shows a perspective view of the Invention. FIG. 8 shows a front view of the top of the rack, depicting means of attaching the rack to a wall. FIG. 9 shows a side view of the Invention showing the attachment rod fixed to a wall area.

DETAILED DESCRIPTION OF THE INVENTION

Figure 7:
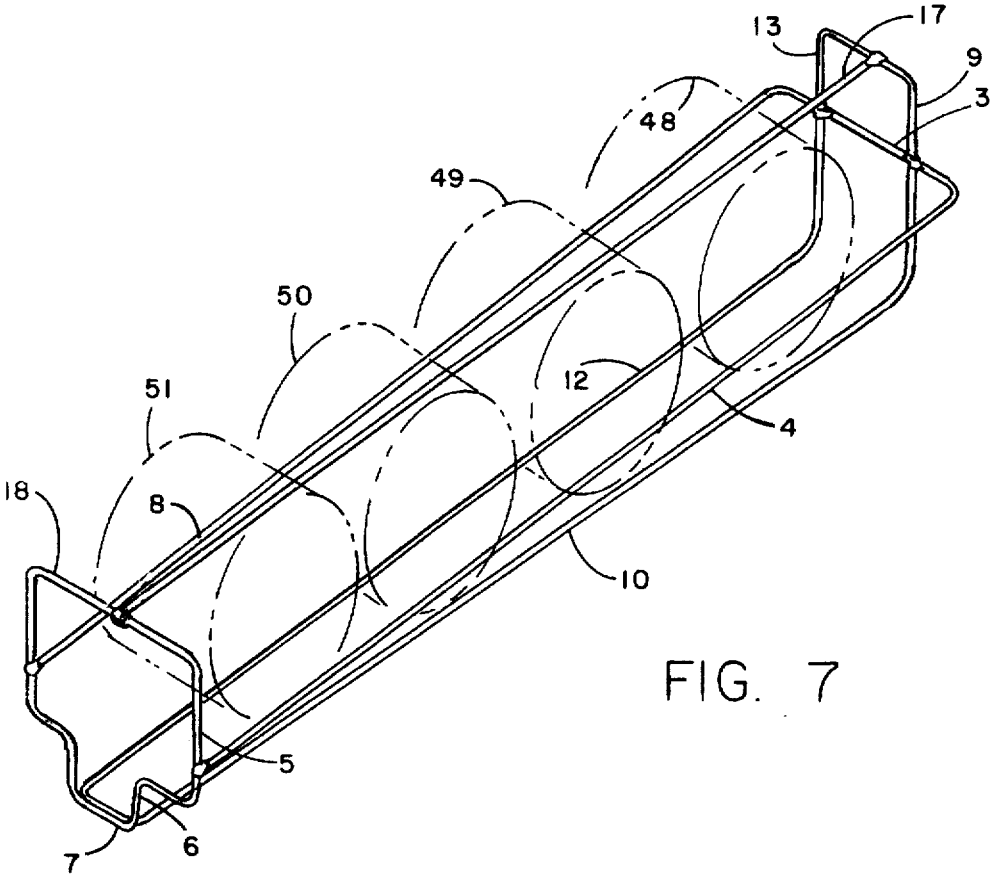

Referring now to FIG. 1, there is shown a cabinet top 1, supported by frame 2. Contained within the cabinet and below the cabinet top is the storage rack of the Invention. The rack has an elevated area removably attached to the inside of the cabinet top 1, utilizing mounting brackets shown. The rack has a top support guide bar 17 which runs from the top rod 14 of upper loop 9 down to the upper rod 18 of the lower loop 5. A pair of lower guide rods 10 and 12 attach the upper loop area 9 to the lower loop area 5 and further provide bottom support for and containment of the toilet rolls shown. Thus, the toilet rolls rest upon rods 10 and 12 and are contained within the side guide rods 4 and 8. The guide rods 4 and 8 run parallel to the top rod 17 as shown and, as stated, provide side containment for the toilet rolls.

The storage rack is likewise depicted in FIG. 7. The toilet rolls 48, 49, 50 and 51 are shown contained within the rods of the storage rack rested upon lower support members 10 and 12. Lower members 10 and 12 are connected to the upper loop 9 and to the lower loop 5. Side guide rods 4 and 8 are shown providing side containment to the rolls. The upper guide rod 17 shown connecting the upper loop 9 to the lower loop 5. As shown in FIG. 7, the upper loop 9 is elevated from the lower loop 5, so that the toilet paper rolls may simply be displaced downward on the rack, as rolls are removed from the lower loop 5.

As shown in the lower loop area 5, there is a smaller loop area defined by rods 6 and 7, which has a smaller cross sectional area than that of the toilet papers thus providing a "stop" to the toilet rolls for containment of the rolls.

The loop 5 is of a larger cross-sectional as that of the toilet rolls, as the rolls are shown stored. Accordingly, the toilet rolls can simply be picked out of the rack through loop 5. The toilet rolls rest upon the smaller loop area 6 and 7 until removed from loop 5 by the user.

FIG. 2 depicts the lower loop 5 of the rack. Loop 5 is composed of vertical and lateral rods integral with the rods 6 and 7.

FIG. 3 depicts the upper loop rod 10. Post 30 and 30(*a*) can be provided for further support.

Attachment rod 24 is shown, which can be removably inserted in brackets 23 and 25. Brackets 23 and 25 are permanently attached to the inside of a cabinet, wall or other structure. Rod 24 contains a hook portion 34 which can be attached onto the upper loop 9 or which can support the upper loop 9 and consequently the rack. Thus, the toilet roll rack can be supported by attachment rod 24 which itself can be readily removed from the structure.

FIG. 4 shows a rear view of loop 9 showing the attachment rod 24 inserted in brackets 23 and 25. Rod 24 contains hook portion 34 which is inserted onto the rack. As shown, rod 24 is beneath rod 17, thus supplying support to the rack. As shown in FIG. 1, the rack can be attached to the inside of a cabinet top 1. Alternatively, as shown in FIG. 4, utilizing rod 24, the rack can be removably attached to a wall or other structure.

Figure 8:
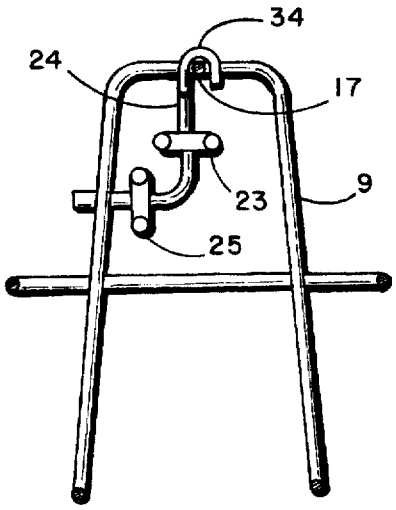

FIG. 8 likewise shows the attached hook 34 about rod 17. The loop 9 rests upon rod 34.

Figure 9:
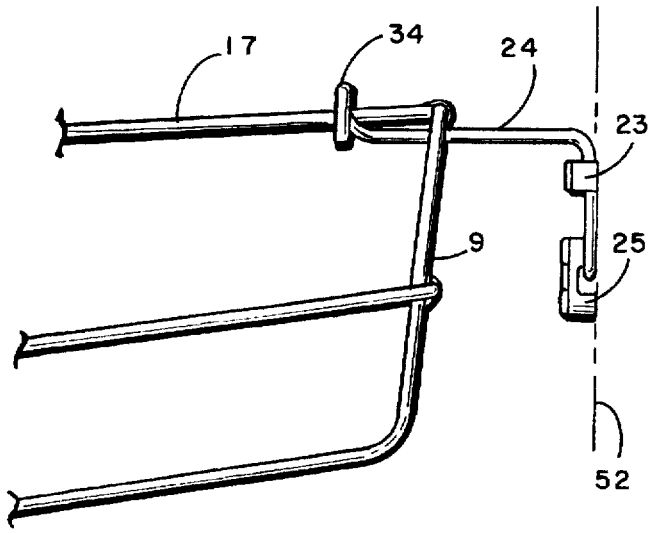

FIG. 9 shows a more detailed view of the novel attachment means. As shown, hook 34 is attached about rod 17. The loop 9 rests upon rod 24 as shown. Rod 24 can be attached to a structure such as a wall, utilizing mounting brackets 23 and 25. As can be seen from FIG. 9, the rack's distance from the structure 52 can be adjusted. The rack is simply placed on a closer or further distant point from structure 52 prior to being placed beneath hook 34. Thus, there are several ways in which the rod 24 can provide removable attachment to and for the rack. Also, the rack can be also supported utilizing brackets such as shown as 20 and 21 in FIG. 2. Further, as shown in FIG. 3, the rack can be supported by posts 30 and 30(*a*).

I claim:

1. A toilet paper storage rack comprised of:

(a) an upper loop;

(b) a lower loop;

(c) at least two rod members connecting the upper loop to the lower loop;

(d) an attachment rod removably attached to the upper loop and permanently attachable to a structure; and (e) a loop portion which is a part of the lower loop depending downwardly there from and which has a cross-sectional area substantially less than that lower loop.

* * * * *